US010391759B2

(12) United States Patent
Ioannou

(10) Patent No.: US 10,391,759 B2
(45) Date of Patent: Aug. 27, 2019

(54) ROTOGRAVURE PRINTING SYSTEM AND THE PREPARATION AND USE THEREOF

(71) Applicant: PARAMOUNT INTERNATIONAL SERVICES LTD., Majuro (MH)

(72) Inventor: Ioannis Ioannou, Rodopoli Attikis (GR)

(73) Assignee: Paramount International Services Ltd., Majuro (MH)

( * ) Notice: Subject to any disclaimer, the term of this patent is extended or adjusted under 35 U.S.C. 154(b) by 0 days.

(21) Appl. No.: 15/306,668

(22) PCT Filed: Apr. 27, 2015

(86) PCT No.: PCT/EP2015/059093
§ 371 (c)(1),
(2) Date: Oct. 25, 2016

(87) PCT Pub. No.: WO2015/162299
PCT Pub. Date: Oct. 29, 2015

(65) Prior Publication Data

US 2017/0043569 A1 Feb. 16, 2017

(30) Foreign Application Priority Data

Apr. 25, 2014 (GR) ..... 20140100242
Mar. 4, 2015 (WO) ..... PCT/EP2015/054536

(51) Int. Cl.
*B41F 13/187* (2006.01)
*B41F 13/11* (2006.01)
(Continued)

(52) U.S. Cl.
CPC ..... *B41F 13/187* (2013.01); *B41F 9/00* (2013.01); *B41F 13/11* (2013.01); *B41F 13/20* (2013.01);
(Continued)

(58) Field of Classification Search
CPC ..... B41F 13/187
(Continued)

(56) References Cited

U.S. PATENT DOCUMENTS 1,965,019 A * 7/1934 Wilkins ..... B41N 1/20 101/375
2,949,852 A 8/1960 Schaefer
(Continued)

FOREIGN PATENT DOCUMENTS

DE 667 594 10/1938
EP 0038385 A1 10/1981
(Continued)

OTHER PUBLICATIONS

International Search Report for PCT/EP2015/059093 dated Jul. 16, 2015.
(Continued)

*Primary Examiner* — Anthony H Nguyen
(74) *Attorney, Agent, or Firm* — Cook Alex Ltd.

(57) ABSTRACT

A rotogravure printing machine has a shaft that rotates and a rotogravure cylinder sleeve for rotation with the shaft. An annular end plate connects to the shaft, and the end plate has a contact surface for contact with a mating contact surface at an inner side of the cylinder sleeve.

19 Claims, 5 Drawing Sheets

(51) Int. Cl.
*B41F 13/20* (2006.01)
*B41N 1/20* (2006.01)
*B41N 3/00* (2006.01)
*B41F 9/00* (2006.01)

(52) U.S. Cl.
CPC ..... *B41N 1/20* (2013.01); *B41N 3/003* (2013.01); *B41P 2213/80* (2013.01)

(58) Field of Classification Search
USPC ..... 101/153
See application file for complete search history.

(56) References Cited

U.S. PATENT DOCUMENTS 3,294,889 A 12/1966 Downie et al.
3,858,287 A * 1/1975 Christoffersen ..... B41F 13/10 101/155
4,044,678 A 8/1977 Rasmussen
4,197,798 A * 4/1980 Bardin ..... B41F 13/10 101/153
4,901,641 A * 2/1990 Steiner ..... B41F 9/00 101/152
5,458,061 A * 10/1995 Koura ..... B41F 13/20 101/216
5,468,568 A * 11/1995 Kuhn ..... B41N 1/20 101/217
5,590,597 A * 1/1997 Balow ..... B41F 13/20 101/216
5,782,181 A * 7/1998 Rossini ..... B41F 27/105 101/153
5,893,328 A * 4/1999 Ghosh ..... B41C 1/1033 101/467
6,210,845 B1 * 4/2001 Hotta ..... B41C 1/1041 101/456
9,878,531 B2 * 1/2018 Ballentine ..... B41F 13/193
9,903,036 B2 2/2018 Ioannou
9,909,201 B2 * 3/2018 Prest ..... C23C 4/18
2002/0040651 A1 * 4/2002 McEachern ..... B41F 13/20 101/382.1
2007/0205001 A1 * 9/2007 Shuster ..... B21D 39/04 166/380

FOREIGN PATENT DOCUMENTS

EP 2719544 A1 4/2014
FR 1275904 11/1961
WO WO 2014/057052 A2 4/2014
WO WO 2014/108172 A1 7/2014
WO WO 2015/028064 A1 3/2015

OTHER PUBLICATIONS

Written Opinion of the International Searching Authority for PCT/EP2015/059093, dated Oct. 29, 2015.
Li, et al., "Microstructure and property of micro-plasma-sprayed Cu coating, Materials Science and Engineering", vol. 379, pp. 92-101, (2004).
Wank, "Basics of Thermal Spray Technology", pp. 1-20, Circa (2005).

* cited by examiner

Sleeve Size Selection Tool Process

ROTOGRAVURE PRINTING SYSTEM AND THE PREPARATION AND USE THEREOF

CROSS-REFERENCE STATEMENT

This is a National Phase of PCT/EP2015/059093, filed Apr. 27, 2015, which claims priority from PCT/EP2015/054536, filed Mar. 4, 2015 and from Greece Application No. 20140100242, filed Apr. 25, 2014, each incorporated by reference hereinto.

FIELD OF THE INVENTION

The present invention relates to a rotogravure printing system comprising a machine provided with a first shaft and means for movement and for rotation of said shaft, and a rotogravure cylinder to be held and to be rotated by said first shaft.

The invention also relates to the use of a rotogravure cylinder in such a printing system, and to a rotogravure cylinder for use therein.

The invention further relates to the use of the rotogravure printing system for printing, by transfer of ink from the cylinder to a substrate, such as a packaging material.

BACKGROUND OF THE INVENTION

Rotogravure is an industrial printing technique that is particularly in use for the printing of materials in high quantities, wherein the printed design is unchanged for a certain period. A properly manufactured cylinder can be resurfaced dozens, if not hundreds of times over the useful life of a cylinder (which in some cases can be as much as 25 years or more); each time at a fraction of the cost to manufacture a new cylinder. Moreover, the high quality of the print generated off of an imaged surface of a rotogravure cylinder is a major advantage over other printing techniques. A further advantage of rotogravure cylinders is the ability to resurface the worn or obsolete imaged copper layer.

Rotogravure is for instance used for printing of packaging materials, but also book covers. The rotogravure cylinder is rotated at high speed during printing. Typically after a substrate has been printed by means of a first cylinder, it will be printed again with a second rotogravure cylinder. Each cylinder is herein provided with the pattern for one specific color ink. The total print is then built up from the overlapping patterns of the different color inks.

In view of the high speed of rotation and the regular exchange of cylinders, printing machines (hereinafter also referred to as printing presses) are provided with a first shaft for holding and rotating the cylinder. Since the cylinders are usually hollow, they are provided with end plates, each with a connection area for the shaft. Such connection area is for instance an aperture fitting for the shaft. Traditionally, the end plates (also known as steel flanges) are permanently fitted into the rotogravure cylinders. A rotogravure cylinder is "set" by mounting the cylinder's steel flange ends into or unto protruding shafts. The steel flanges are sized and shaped to allow a rotogravure cylinder to be set on a printing press. The steel flanges produce significant support across the length of the cylinder during press runs and therewith allow production of high-quality images.

The end plates may be attached to the cylinder by means of pressing the end plates into the bore of the cylinder, or alternatively by means of mechanical attachment. One such mechanical attachment is known from U.S. Pat. No. 3,294,889. In said known system the shaft—just one—is also part of the cylinder. Another embodiment is known from EP0038385. These end plates are quite important, since they are responsible for transmission of the power from the shaft to the surface area. Moreover, any space between the shaft and the end plate will translate itself into mistakes with the printing, i.e. it would easily lead to misalignment between the various cylinders each transferring a pattern to the substrate that jointly forms the desired image.

For a variety of reasons, different printing presses from the same of different manufacturers have non-standard shaft dimensions. Consequently, when receiving an order to manufacture a new cylinder, the manufacturer must also be provided with the exact shaft size dimensions the cylinder is to be mounted on so as to attach the necessary flanges to the cylinder so it can be used on the desired printing press.

Traditionally, the cylinders comprise a base of steel at the outside of which a plurality of layers is deposited. These layers typically comprise an adhesion layer, a support layer, an engraving layer and normally a chromium-based protection layer. In order to attach the end plates use may be made of pressing the end plates into the bore, and more particularly clamping of those end plates. This is a permanent fitting of the steel flange of an end plate into the rotogravure cylinder. Over time, printer facilities tend to amass a large stock of rotogravure cylinders for possible future resurfacing. The high investment cost to have a cylinder produced and shipped to the printer in the first place is a deterrent to recycling, as is the fact that accommodations must be made to have heavy steel cylinders transported for recycling. Also, recycled cylinder is not a high value commodity which means there is little return revenue generated from recycling.

All in all, most printer facilities elect to keep (store) used cylinders with the expectation that a cylinder's specifications (including insert dimensions) may match the need to place an order for a new cylinder. When this occurs, resurfacing an existing cylinder is often a lower cost option than ordering a new one. Recently, improvements have been made to make rotogravure cylinders less heavy and allowing resurfacing. However, one of the initial and key elements of resurfacing involves loading the insert ends of the cylinder onto an apparatus which is used to remove the engraved copper layer by machining. The machining process completely removes the old image and prepares the cylinder for copper re-plating after which a new image will be etched using conventional means. When necessary or prudent, the entire copper layer is removed down to the original base.

Some printer facilities are able to in-house manufacture gravure cylinders. However, this is not the norm. Most printer facilities have cylinders manufactured off-site, which means that any resurfacing involves sending a stocked cylinder to a remote site where it is machined, re-plated and re-imaged, and generally also re-chromed. Re-chroming involves bathing the re-imaged layer in chrome (usually a hexalent-chrome bath solution, which is quite toxic to the environment in natural form and thus must be contained and handled in a manner which adds to the cost of cylinder production). The very use of chrome plating in gravure cylinder production and the significant weight attribute of cylinders being made of steel (which can be a difficult handling and transportation problem, particularly in countries or regions of the world where weight restrictions are taken seriously), has driven many printers to search for alternatives to gravure printing, driving down demand for gravure cylinder production. The transition to different printing approaches, including flexographic and digital printing in some cases, by way of example, over time is believed to have discouraged R&D activities aimed at trying to come up with solutions on making gravure cylinders and gravure printing better, cheaper, and more commercially competitive than alternate technologies.

Improved gravure cylinder configurations that address the above challenges with gravure printing, and restore demand for the high(er) quality nature of gravure printing is greatly desired by the industry.

SUMMARY OF THE INVENTION

It is therefore a first object of the invention to provide an improved method of operating a rotogravure printing system.

It is a further object to provide an improved gravure cylinder configuration for use in such a method.

According to a first aspect, the invention provides a method of operating a rotogravure printing system comprising a machine provided with at least one shaft and means for rotation of said shaft, which system further comprises a rotogravure cylinder sleeve provided with a gravure at a printing surface, which cylinder sleeve is to be rotated by means of the at least one shaft, and further comprising at least one end plate for transfer of said rotation of the shaft to the cylinder sleeve, which method comprises the steps of:

- assembling the end plate and the cylinder sleeve in a manner suitably for disassembly, which end plate is provided with at least one contact surface that is designed for contact with a mating contact surface defined at an inner side of the cylinder sleeve,
- mounting the end plate and the cylinder sleeve onto the shaft;
- carrying out a printing operation, comprising the step of rotating the at least one shaft, and therewith the rotogravure cylinder, so as to print the substrate in accordance with the gravure, and thereafter, Disassembling the end plate and the cylinder sleeve.

According to a second aspect, the invention provides a combination of a rotogravure cylinder sleeve provided with a gravure at a printing surface, and at least one end plate for transfer of rotation of a shaft to be inserted through the end plate to the cylinder sleeve, wherein the end plate is provided with at least one contact surface, and the cylinder sleeve is provided with a mating contact surface defined at an inner side thereof, wherein the contact surface are fit to constitute a disassemblable assembly of the cylinder sleeve and the end plate.

According to a third aspect, the invention provides a rotogravure system comprising a machine provided with at least one shaft and means for rotation of said shaft, which system further comprises a rotogravure cylinder sleeve provided with a gravure at a printing surface of the above mentioned combination.

According to a fourth aspect, the invention provides a cylinder sleeve suitable for use in the combination.

According to a fifth aspect, the invention provides an end plate suitable for use in the combination.

It has been understood by the inventor that the existing printing system can be improved and the manufacturing time of rotogravure cylinders significantly reduced, in that the end plates are no longer permanently fixed into the cylinder sleeve, but may be assembled and disassembled. A practical consequence hereof is that a single end plate should fit to a plurality of cylinders, rather than providing a couple of a cylinder and a dedicated end plate. Still, the effective tolerance between the end plate and the cylinder may not be increased, so as to prevent loss of printing quality. This sets very high requirements of uniformity to the dimensions of rotogravure cylinders, and not merely at the outside but also at the inside of the cylinder sleeve.

Thereto, the invention provides a light-weight cylinder, such that the magnitude of force to be transmitted via the end plates is significantly reduced. Moreover, the invention provides a contact surface at the inner side of the cylinder sleeve, adjacent to at least one and preferably both opposed lateral ends, which contact surface mates with the contact surface of the end plates, which suitably have standardized dimensions, at least standardized for one client. In other words, the contact surfaces at the inner side of the cylinder will be created so as to correspond to the required dimensions. This can be particularly suitably achieved using a cylinder sleeve with a base and a layer package, wherein the layer package is thermally sprayed, more particularly by means of high-velocity thermal spraying. This allows the creation of a layer package without electroplated layers and such that the hardness of the layer package, and particularly the engraving layer, is higher than that of the base. In a preferred embodiment, the hardness of the layers increases from the base towards the engraving layer. Most suitably, the engraving layer is a copper-based (i.e. copper or alloy thereof) with a Vickers Hardness in the range of 300-600 HV, preferably 400-550 HV. More preferably, the cylinder is used without additional protection layer, particularly without chrome-based protection layer. It has been found that cylinder sleeves based on such manufacturing process and particularly engraved with laser engraving can print patterns with less ink, than traditional sleeves with a chrome-based protection coating. This lower ink consumption is due to a better ink transfer. Hence, on the basis of the improved cylinder manufacturing based on a light-weight cylinder, it has become possible to allow that the cylinder sleeve and the end plate(s) are no longer permanently assembled, but rather can be disassembled after a printing operation. This is particularly useful, already since a rotogravure printing system usually is operated with a plurality of rotogravure cylinders, so as to enable the provision of different colors of the image.

More preferably, the thermally sprayed layers are applied by means of HVAF and HVOF technologies. Such layers show an improved adhesion to the underlying cylinder base, and may be provided with sufficient hardness for use as engraving layer. The hardness thereof may even be higher than the hardness of layers made with electroplating. Moreover, the thickness of the layer package may be reduced when using thermally sprayed layers, in comparison to electroplated layers. Therewith, the cylinder weight is kept low. This has the additional advantage that the force transmission from the shaft to the cylinder may be achieved by means of a single end plate, rather than a first and a second end plate as needed in the prior art.

Preferably, the contact surfaces at the inner side of the cylinder are defined in the cylinder base, which suitably comprises aluminum. This definition in the cylinder base means that the contact surface is created by means of material removal from the aluminum cylinder rather than the assembly of an additional ring-shaped element. Hence, any variation in the dimensions of the inside of the cylinder base after its initial manufacturing may be corrected by means of the material removal.

In a further embodiment, an end plate is provided with a plurality of contact surfaces, which are mutually spaced apart, when viewed along a circumference of the annular end plates. Preferably, a single end plate is provided with at least three contact surfaces. This turns out beneficial, since an improved self-centering of the end plate is obtained. The spacing apart is deemed an area where no contact with the cylinder is foreseen. Preferably, the contact surfaces extend further, when seen in radial direction, than the edge of the "spacing apart" areas. Therewith an cavity is created between the cylinder and the end plate. This seems handy for handling of the end plate during insertion into and removal from the cylinder. A tool, such as a gripper, could be placed in such cavity. In this manner, extra force can be provided, while the contact surfaces will not be damaged. In a further embodiment, the contact surface at the inner side of the cylinder is not limited in its extension, but substantially continuous. The contact surface suitably are configured to cover between 25 and 75% of the (surface area of) the circumference. Usually, the coverage is in the range of 30-70%, for instance in the range of 45-55%.

In addition or as an alternative to a gripper gripping at one or more of the retracted surfaces, means may be present for providing compressed air into an inside of the cylinder, with the end plates mounted thereto. Most suitably, such means are combined with end plates having one or more air passages. By applying compressed air into the inside, the pressure is exerted on the end plate that may assist in dismounting the end plates from the cylinder sleeve, when so desired.

The contact surfaces are preferably tapered, particularly such that the contact surfaces enclose an oblique angle with the axis of rotation. More specifically, the contact surface at the inner cylinder has an increasing diameter in the direction along the axis of rotation towards the lateral edge of the cylinder. (The diameter is herein effectively the diameter of the bore within the cylinder). The tapering angle, as defined relative to the axis of rotation, is suitably at most 10 degrees, more preferably 5 degrees or less. Such a small tapering angle with the corresponding slow increase of the diameter, has the advantage to ensure a sufficiently large contact surface without the need for a thick cylinder.

More preferably, the contact surfaces are furthermore provided with locking means. Such locking means are in one embodiment mechanical locking means, for instance a combination of ribs and complementary channels. It is preferably that the locking feature or the pattern of locking features is applied in a repetitive manner on the contact surface of the cylinder. Such repetitive application of locking features enables flexibility during insertion, i.e. rotational freedom as much as possible.

In one further implementation, electrical or electrically driven locking means may be present. For instance, a locking feature, such as one in the end plate, may be unlocked in electrical manner, for instance in that the feature is actuated electrically. When actuated (i.e. retracted), the feature is no longer locked and the end plate may be removed from the cylinder sleeve. Due to the combination of the shaft and the end plate, it is feasible to extend a (electrically insulated) cable through the shaft and along the end plate. For the electrical connection of the rotating shaft to the machine, use may be made of a wireless connection. Alternatively, use may be made of a battery, such as a rechargeable battery.

The cylinder sleeve as used in the invention may be applied both in printing machines operating with a single shaft and printing machines operating with a first and a second shaft, which are mutually aligned so as to have a single axis of rotation. In suitable embodiments of machines (and systems) with a single shaft, the first end plate is deemed primarily responsible for the force transmission. The shaft is herein suitably long enough so that upon assembly of the shaft and the cylinder, a tip of the shaft is arranged at the second lateral edge of the cylinder. In such case, a closing plate is suitably arranged between the tip of the shaft and the contact surfaces at said second lateral edge of the cylinder. Such a closing plate may be arranged into the cylinder prior to assembly or may be assembled to the system upon or after the assembly of shaft and cylinder. The closing plate may be, in one embodiment, of a design substantially identical to an end plate. Alternatively, the single shaft could be attached to the first end plate only, without running through the entire cylinder.

In machines with a first and a second shaft, each of the shafts is suitably provided with an end plate. The cylinder is then squeezed between the said end plates of the shafts. During rotation, either one or both shafts may be driven to rotate. The driving by means of a single shaft may be preferred and is also feasible in view of the reduced weight of the cylinder sleeve. The shafts are herein suitably provided with conical (or tapered) ends.

While the term 'end plate' suggests a location at a lateral end of a cylinder, this is not necessary. The end plate may be located at the inside of the cylinder and spaced apart from a lateral edge. Such a location may be advantageous, so that the end plate is subject to less and smaller vibrations than at a lateral end of the cylinder, resulting in a more uniform force transmission to the cylinder. Moreover, in case of driving the cylinder via a single shaft only, a location of the endplate spaced apart from a lateral edge, the force transmission may be more uniform. Particularly, the distance between said driving end plate and the opposed lateral edge is shortened, resulting in a smaller moment of force.

The end plate may be a single element or may be made of a plurality of elements, such as a plurality of annular parts. The end plate may be made in a single material, such as aluminum or steel, or may comprise more than one material, such as an inner ring of steel and an outer ring of aluminum. It is deemed suitable to construct the end plate on the basis of an inner annular part and an outer annular part. Fixation of the inner and outer part may be implemented in various ways. Suitably, the inner part is provided with a radial extension so as to rest on the outer annular part. The radial extension will thus have a larger diameter than a minimum diameter of an aperture in the outer annular part. More suitably, the inner part is further provided with connection means for fixation. This connection means are preferably assembled to the inner part from the opposed side of the outer part, and are also provided with an radial extension. In this manner, the outer part is sandwiched between said radial extensions. More preferably, the outer part may be provided with a convex inner surface facing the aperture. The convex inner surface is for instance provided with tapered sections on opposed sides.

The contact surface of the end plate is suitably provided with a protective coating to reduce wear and to increase the working life. Such a coating is for instance applied by means of physical vapour deposition. Most suitably, as discussed hereinabove, the end plate is provided with a first, second and third contact surface at its circumference. Retracted surfaces are defined between said contact surfaces, so as to define cavities between the cylinder and the end plate. More preferably, a stopping edge may be provided at the circumference of the end plate, i.e. in the form of a ring. This ring is to be arranged such that it is continuous with the contact surfaces. The stopping edge is particularly defined at that side of the end plate which will lie against the cylinder, when both elements are put together. For sake of clarity, the relevant side of the end plate is the side facing towards the cylinder when the shaft with the end plate moves towards the cylinder.

The end plate is typically provided with a bore into which the shaft fits. In one embodiment, the bore has a tapered shape, corresponding to the shape of particularly a portion of the shaft. Alternatively, the bore may be provided with grooves or cavities suitable for fins extending from the shaft. Suitably, such fins have a tapered shape. The advantage of the tapered shape is that it prescribes a position of the end plate along the shaft. Moreover, a tapered shape may be manufactured in a comparatively easy manner.

The fixation of the end plate to the shaft may be obtained in several manners. The provision of such fixation is in itself known in the art, for instance with complementary locking features defined in the shaft and in the end plate, or alternatively with separate locking members.

Rather than providing a pre-assembly of the shaft and an end plate, it is deemed feasible that a pre-assembly is provided of the end plates and the cylinder sleeve. This preassembly is subsequently combined with the at least one shaft of the printing machine.

In a further embodiment, the layer package of the cylinder comprises a resizing layer. Since the present invention strictly specifies the (inner) dimension of the cylinder, which also can influence the outer diameter of the cylinder base, a specific resizing layer is advantageous so as to obtain any outer diameter desired by a client. Good results have been obtained with a resizing layer comprising zinc, i.e. a zinc layer, which is also understood to contain any zinc alloys.

In again a further embodiment, the contact surfaces at the inner side of the cylinder sleeve are provided with a protective layer. This protective layer may be applied in the form of a coating, for instance a chrome-containing coating. The protective layer may also be formed in situ in a reaction. When the material of the cylinder is aluminum, one preferred treatment is the anodisation of aluminum. Mechanical treatments may also be provided, for instance by burnishing the said contact surface, particularly defined in aluminum.

According to a particularly relevant embodiment, the gravure cylinders have a cylinder base (or core) of aluminum or aluminum alloy in standardized stock bore dimensions. Suitable size for instance range from 250 to 850 cm using a predetermined number of fixed-increasing size aluminum stock bore dimensions. The cylinders with bore of this standardized bore dimensions are further provided with a layer of thermally sprayed material. This layer has for instance a maximum thickness of 15 cm, more preferably at most 5-10 cm. Therewith, it becomes feasible to stage cylinder core outer diameter in regular increments, for instance in increments of between 10 and 40 cms, such as 15-25 cms or 20 cms. Having a fixed pool of aluminum cores to work with also serves to provide a useful tool by which to set the outer diameter of removable end plates to be made available for use with sleeves as presently proposed. Thus, the present approach indirectly drives gravure industry toward standardization aimed to benefiting all involved thus driving down costs of gravure printing and hopefully attracting business from other printing technologies. It is envisioned that the process of selecting and matching a sleeve to the best fit aluminum preform stock, taking into account the flexibility and desirability of using stepped selection formula, may be automated.

Moreover, by using a cylinder with aluminum bores and a thermally sprayed layer with standard thicknesses, the overall cylinder hardness and other mechanical properties are highly controllable. Therewith, it is feasible to make arrangements wherein the end plate is removable from the cylinder and nevertheless can be re-arranged without risk of sliding or wrong arrangement of the cylinder to the shaft that would be detrimental for the alignment, particularly in a situation, wherein a printing press is conceived to work with a plurality of cylinders arranged in parallel.

BRIEF DESCRIPTION OF THE FIGURES

These and other aspects of the invention will be further elucidated with respect to the following figures, wherein.

DETAILED DESCRIPTION OF ILLUSTRATED EMBODIMENTS

Figure 1:
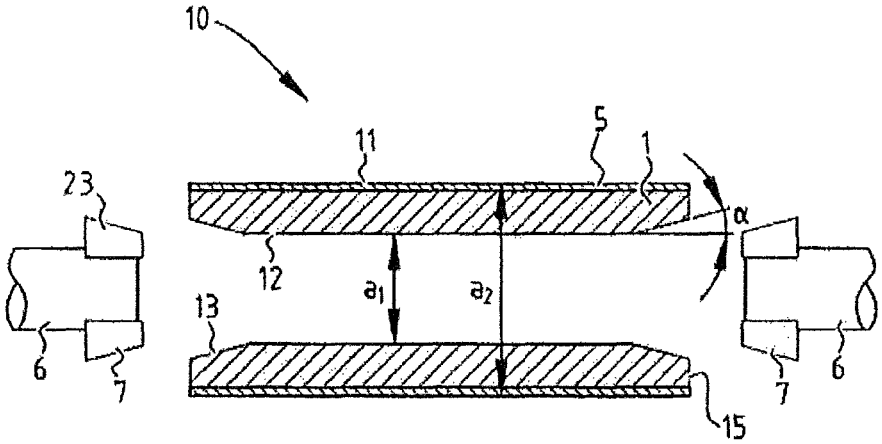
FIG. 1 shows a cross-sectional view of the printing system of the invention according to a first embodiment.

The Figures not drawn to scale and they are only intended for illustrative purposes. Equal reference numerals in different figures refer to identical or corresponding parts.

The term 'rotogravure cylinders' relates herein to rotogravure cylinders and/or any gravure cylinders used in the printing industry, particularly for the printing of packaging materials. The length of such cylinders is typically at least 1.0 meter, more preferably in the order of 1.5-2.5 meter.

The term 'cylindrical base' as used in the context of the present invention does not require the base to be a block-like material. Rather and preferably, the base may be hollow.

The term aluminum in the present invention refers to pure aluminum, aluminum with small addition of other materials or aluminum alloys. Likewise, the term copper refers to pure copper, copper with small addition of other materials or copper alloys. Most suitably, however, in the process in accordance with a preferred embodiment of the invention, particles are sprayed that contain at least 99% copper, more preferably at least 99.5% copper or more. Likewise, the term 'zinc layer' comprises a zinc layer and a zinc alloy. The zinc content of such a zinc alloy may vary over a wider range. One feasible alloy is for instance brass (in any of the commercially available compositions).

The term high velocity spraying relates to a spraying process wherein particles are sprayed with a velocity of at least 300 m/s, more preferably at least 500 m/s, at least 800 m/s or even at least 1,000 m/s. Preferably, use is made of a jet with a velocity above the said particle velocity. Generation of a supersonic jet is considered most advantageous. Herein, the jet velocity may be higher than 1,400 m/s. High velocity spraying may for instance be implemented with High-Velocity Air Fuel (HVAF) technology and guns as commercially available Printing cylinders or rollers currently used in the printing industry comprise of:

a hollow cylinder base, which is usually made of steel or aluminum an intermediate layer, suitably for adhesion to the cylinder base. Such intermediate layer for instance comprises a material known in the art as "soft" copper;

an engraving layer, suitable for engraving of a desired pattern. This engraving layer for instance comprises a material known in the art as "hard" copper and suitably has a high hardness, for instance in the range of 200-240 HV;

a protection layer, which is usually a chromium layer on top of the "hard" copper layer and end plates on both lateral ends of the cylinder. The end plates may be connected to the cylinder by means of mechanical means, or be inserted into the cylinder and then mechanically pressed and therewith fixed to the cylinder.

The cylinder base is usually made of steel which satisfies the requirements for precision and small deflection required in the printing process. Alternatively for the printing industry, the cylinder base can be manufactured from a light weight metal like aluminum or an aluminum alloy. Aluminum has specific weight of about 2700 kg/m$^3$, while steel has a specific weight of about 7800 kg/m$^3$. Using aluminum as the cylinder base results in a lighter rotogravure cylinder (by about one third) which means significant reduced transportation costs and safer handling during production phases.

The conventional method of manufacturing a printing cylinder involves plating the cylinder base made of steel in electroplating solutions to plate the soft copper layer, the hard copper layer and the chromium layer after engraving. This process has been described in many patents. Recent innovations made by the Applicant and described in non-prepublished applications (mentioned hereinafter) demonstrate the manufacture of cylinders with a layer package comprising one or more layers made by thermal spraying, such as high-velocity thermal spraying. This has resulted in cylinders with improved properties and an increased versatility, i.e.:

the use of high velocity thermal spraying with at least partial melting results in less surface porosity, better adhesion of the layer package to the cylinder base and better dimensional accuracy, as discussed in PCT/EP2013/071195;

the use of a single layer copper support that matches the difference in properties between the base and a copper engraving layer with a high hardness, for instance in the range of 250-500 HV, as discussed in PCT/EP2013/067895;

the provision of a zinc layer for refurbishing and/or resizing printing cylinders, as discussed in PCT/EP2013/050228;

In International Patent Application PCT/EP2013/067895, filed on 29 Aug. 2013, also by the same inventor incorporated here by reference, the dual layer approach of making new cylinders (involving an intermediate layer followed by a plated copper layer) is replaced by a single high velocity copper particle layer which is thermal sprayed directly on a preferable aluminum base. For the first time, a thermal sprayed copper layer serves as the actual engrave layer, completely eliminating copper plating altogether. Despite the harder surface properties of the thermal spray deposited copper later it was shown that it is feasible, in fact desirable and highly efficient, to mechanically image or laser etch an image thereon. The harder surface in fact, for many applications, eliminates the need for chrome plating, resulting in a cylinder that is completely eco-friendly, low-cost, and faster to produce, among other benefits.

The hollow base cylinder comes with specific inside and outside diameter. The thickness of the base cylinder, i.e. the distance between the inside and outside diameter, is important since the integrity of the printing cylinder when working on the printing machine depends on the two basic dimensional parameters of the cylinder, the length of the cylinder and the thickness of the cylinder. Therefore it is of paramount significance to manufacture the cylinder with the minimum thickness required for each cylinder length to avoid excessive deflection.

Once the base cylinder is cut according to the length required by the customer and having the appropriate thickness to ensure the integrity of the cylinder during printing, the surface of the cylinder is processed to provide an outside layer of material which can be engraved with the pattern required by the customer.

Prior to the engraving and suitably after the provision of the layer package, the end plates are assembled to the cylinder base according to the conventional process. The purpose of the end plates is to enable installation of the cylinder or roller on the printing machine's shaft. Such a printing press may have several cylinders mounted in parallel working together to transfer a corresponding portion of an intended pattern to the substrate that is ultimately to be imaged. Misalignment in the printed process by one cylinder will adversely impact the entire printed result. Consequently, end plates must be perfectly sized and secured, which is one reason why they are traditionally permanently fitted into position by the cylinder manufacturer and not configured as slip-on ("slidable") attachments.

With widespread adoption of aluminum base cylinders, introducing a steel flange into an aluminum base sleeve introduces frictional and torque disparities. Similarly, an aluminum flange quickly deforms when subjected to the rotational forces and stresses induced by a driving shaft running therethrough, particularly at very high speeds. One solution is to make each flange in two-part assembly form: one part being aluminum and the other steel. By making the aluminum flange part substantially annular, it could made to fit around the steel flange part and inside the cylinder base. The assembly of the aluminum and the steel part of the flanges were designed to be permanently set in position by heating (normal or induction heating) and press fitting the two parts. Unfortunately, the fitting of a two-part flange is prone to deformation of the cylinder and/or the flange during cylinder manufacture. Deformation of a cylinder is a costly and particularly undesirable event, not to mention, time consuming from a production standpoint.

The present disclosure describes an improved cylinder sleeve and cylinder end plate combination, as well as various embodiments to show different possible configurations for carrying out the inventive aspects. The words cylinder and roller will be used interchangeably in the following text.

Figure 2:
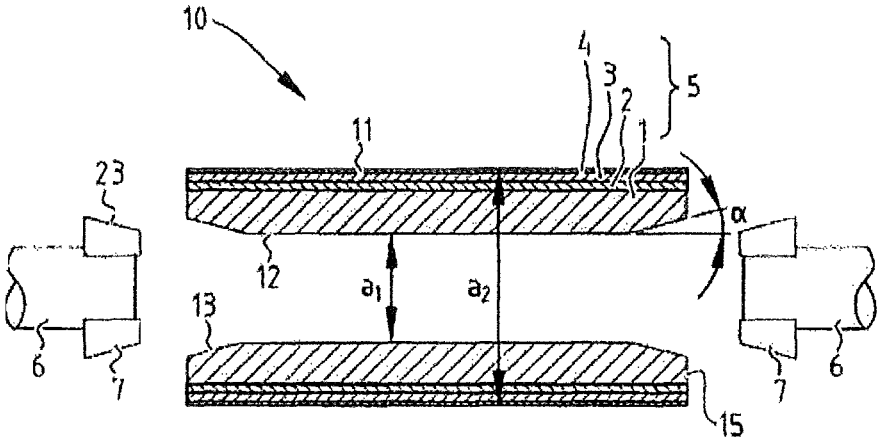
FIG. 2 shows a cross-sectional view of the printing system of the invention according to a second embodiment.

FIGS. 1 and 2 show diagrammatical view of the printing system comprising a shaft 6 and a rotogravure cylinder sleeve 10 according to a first and a second embodiment of the invention. The cylinder sleeve 10 is provided with a printing surface 11 at its outside and an inner side 12. The cylinder sleeve 10 comprises a cylinder base 1 and a layer package 5 at its outside, such that the pattern to be printed on a substrate is present in an engraving layer 3 part of the layer package 5. As shown in FIG. 2, it is feasible that the layer package 5 substantially consists of a single layer.

The cylinder sleeve 10 is hollow. It therefore has an inner diameter a1 (also called inside cylinder base diameter), and an outer diameter a2. The cylinder sleeve has a cylinder base 1, which has a thickness b1. The outer diameter a2 is primarily defined by means of the thickness b1 but may be modified by means of a resizing layer, such as a zinc layer, as is described in the above mentioned patent application that is herein included by reference. The cylinder sleeve 10 is further provided with lateral edges 15. Contact surfaces 13 are defined adjacent to the lateral edges 15 and in the cylinder base 5. The contact surfaces 13 are tapered and include an angle $\alpha$ relative to the inside 12 of the cylinder, or more systematically, relative to an axis of rotation aligned with the shaft 6.

Figure 3:
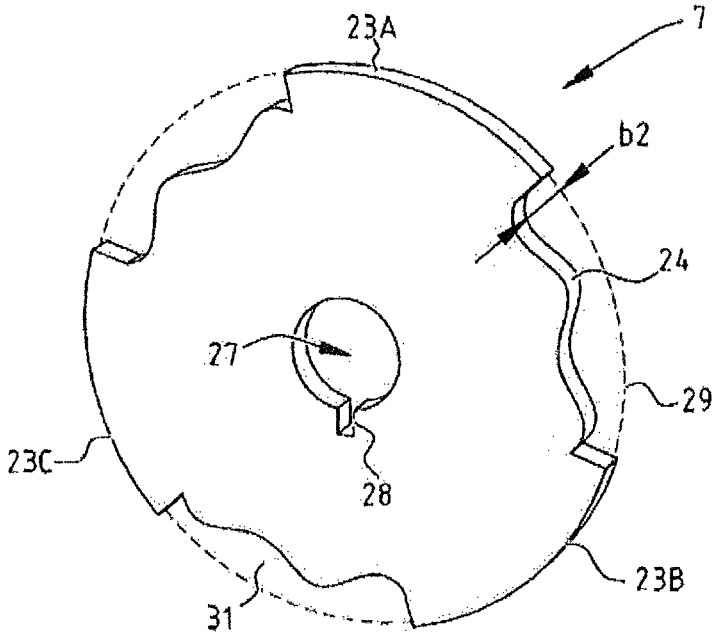
FIG. 3 shows a diagrammatical view of an end plate for use in the system of the invention.

In accordance with the invention, the end plates 7 are connected on the shaft 6 of the machine. Suitably, use is made of a first and a second end plate 7 for insertion into the cylinder at opposed lateral ends 15. These end plates 7 are made in a way as to fit both to the sleeve inside diameter a1 and the machine shaft diameter. Thereto, they are provided with at least one contact surface 23 at their outer edge 29 (as shown in FIG. 3), which contact surface 23 matches a mating contact surface 13 on the inner side 12 of the cylinder 10. Suitably, as shown in the FIGS. 1 and 2, the contact surfaces 23 of the shaft end plates 7 have an inside tapered shape, and they fit to mating contact surfaces 13 of the cylinder 10 having an outer tapered shape. Though not shown in the diagrammatical FIGS. 1 and 2, the contact surfaces 13, 23 may furthermore be provided with locking means, such as a complementary mechanical features, for instance ribs (protrusions) and channels (grooves). Suitably such features extend in an axial direction, such that the features do not hinder insertion or removal of the end plate. Preferably, the features furthermore have an extension in radial direction, such that the end plate may be fixed by means of a slight rotation movement after or in the course of its insertion into the cylinder. The shaft 6 is suitably provided with segments of different diameter, more particularly, a segment configured for connection with the end plate 7 may have a smaller diameter than the rest of the shaft 6. However, this is merely one implementation.

As shown in more detail in FIG. 3 locking means 29 may be available for locking the end plates 7 to the shaft 6. In the embodiment shown in FIG. 3, the locking means 29 in the end plate 7 is embodied as a cavity of specific size coupled to a bore 28 for the shaft (not shown in FIG. 3). The shaft is suitably provided with a complementary locking feature (not shown) that fits into the locking means (i.e. cavity) 29. The locking feature of the shaft may further be designed so as to specify a position of the end plate 7 along the shaft. FIG. 3 furthermore shows a preferred design of the end plate 7, wherein the end plate 7 is provided with a first, second and third contact surface 23A, 23B, 23C. These contact surfaces 23A-23C are designed in centro-symmetrical manner according to the shown implementation. This is deemed beneficial from the perspective of user flexibility and the distribution of forces, though it is not essential. Three contact surfaces 23A-23C is deemed preferred over one or two contact surfaces, since the force may be transferred therewith evenly in "x" and "y" directions. It is not excluded that more than three contact surfaces are present. In the embodiment shown in FIG. 3, the contact surfaces 23A-23C cover approximately half of the outer edge 29—which is an imaginary element. More generically, it is deemed suitable that the contact surfaces jointly cover between 30 and 70% of the said outer edge.

As is further shown in FIG. 3, empty spaces 31 are present between the contact surfaces 23A-23C. The shape of these empty spaces 31—or more precisely, the exact shape of the end plate 7 outside the contact surfaces 23A-23C—is herein shown highly diagrammatical. In this Figure, the retracted surface 24 is rough, i.e. not polished. This is likely the case, but not essential. The retracted surface 24 is retracted over a distance b2. This distance b2 is suitably sufficient for any tool, such as a gripper to get into the empty space 31 and to grip the end plate 7 at its retracted surface 24 and/or a rear side of the end plate for adequate positioning or removal, when needed. A printing machine may be equipped with an automatic version of such a gripper tool, such that no time will be lost in insertion or removal of the end plates 7 into the cylinder 10. It is added for sake of clarity that the contact surfaces 23A-C of the end plate 7 as shown in FIG. 3 are not tapered. While tapering of these surfaces is deemed highly beneficial, the effect thereof could be obtained differently, for instance by means of a stop specified inside the cylinder 10, against which the contact surfaces 23A-C will be lying if positioned correctly within the cylinder 10.

Figure 4:
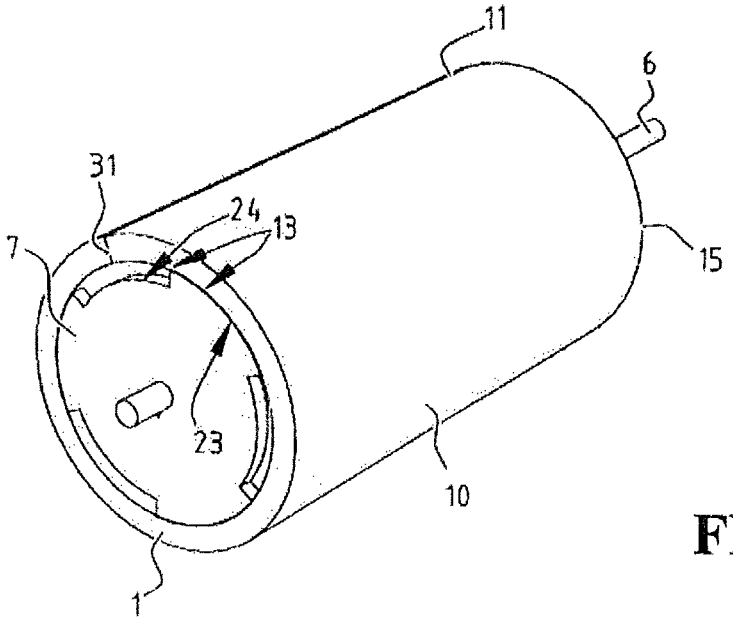
FIG. 4 shows a diagrammatical view of the system in a bird's eye perspective.

FIG. 4 shows in a bird eye's perspective the printing system of the invention comprising the cylinder 10 and the shaft 6 with end plates 7. This FIG. 4 shows schematically how the mating contact surfaces 13, 23 are in match fit and it further shows the location of the empty space 31 between the contact surface 13 of the cylinder and the retracted surface 24 of the end plate 7. The contact surface 13 is suitably continuous to provide rotational freedom upon insertion of the end plate 7 into the cylinder 10. In the shown embodiment, the end plate 7 is arranged inside the cylinder 10, with the front side of the end plate substantially aligned with the lateral edge 15 of the cylinder. Alternatively, the end plates 7 may be arranged at a location further inside the cylinder 10 (i.e. such that their front sides are not aligned with the lateral edges 15). Thereto, the contact surface 13 of the cylinder 10 may have a greater depth than the contact surface 23 of the end plate, or the cylinder may be provided at its inner side 12 with a guiding edge or surface followed by the contact surface 13.

Thus, the sleeve type cylinder 10 will be produced, in one embodiment, with specific internal diameters a1, minimum thickness b1 to ensure integrity and an outside diameter a2 that varies according to the customer requirements. One advantage of this new sleeve type printing system is the reduced production cost and minimization of raw material usage, since the printing cylinder 10 is not manufactured with end plates 7. This saves considerable quantities of raw material usage for the manufacturing of the end plates 7. The end plates 7 with the preferably tapered contact surfaces 23 are now part of the printing machine, are manufactured once by the printer and are used for any cylinder sleeve 10 with specific inside diameter a1. The end plates 7 are suitably comprised of either a single metal or can be a composite (e.g. steel and aluminum) as described in patent application EP12187941.5. It is considered beneficial that the end plates 7 are made from steel. The standardization introduced by the current invention is revolutionizing the management of the printing rollers both on the cylinder manufacturer side, on the printing machine manufacturer side, as well as on the printer side.

Figure 5:
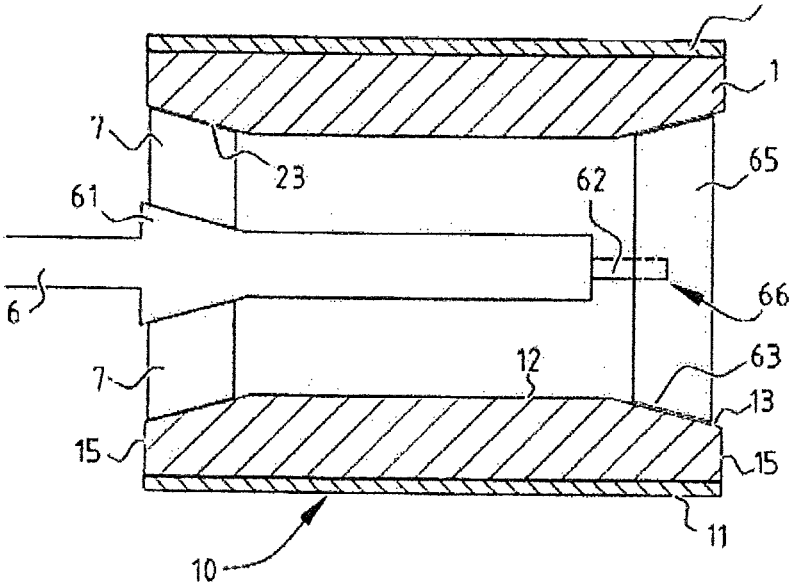
FIG. 5 shows a diagrammatical cross-sectional view of the printing system of the invention according to a further embodiment.

FIG. 5 shows a further embodiment of the printing system of the invention. The system of this embodiment is provided with a single shaft 6, rather than the first and the second shaft as shown in FIGS. 1 and 2. In this embodiment, the system is provided with an end plate 7 and additionally with a closing plate 65. The end plate 7 and the closing plate are assembled to opposed lateral edges 15 of the cylinder sleeve 10. Both the end plate 7 and the closing plate 65 are provided with contact surfaces 23, 63 mating corresponding contact surfaces 13 of the cylinder sleeve 10. Since the cylinder sleeve 10 is suitably manufactured so as to be usable in printing systems with either one or two shafts for holding and rotating a single cylinder 10, the contact surface 13 in contact with the contact surface 63 of the closing plate 65 suitably does not differ from the contact surface 13 in contact with the contact surface 23 of the end plate 7.

The shaft 6 is herein shown with a fin 61 and with a tip 62. The fin 61 is present so as to improve the connection with the end plate 7. The fin 61 is tapered, with the consequence that the end plate 7 is sandwiched between the shaft 6 and the cylinder sleeve 10. Rather than a tapered fin 61, the shaft could thereto be provided with a tapered protrusion, suitably an annular protrusion, or alternatively ribs. Furthermore, it is feasible that the shaft 6 is without tapered fin 61 or tapered protrusion. The end plate 7 is suitably provided with a surface around its bore (27, see FIG. 3), that matches the surface of the shaft 6 with the fin 61. The tip 62 of the shaft 6 ends up in a cavity 66 defined in the closing plate 65. The cavity 66 is suitably designed so as to obtain a stable construction. The use of a closing plate 65 herein is beneficial for a stable construction, and moreover prevents flow of air and/or dusts into the inside of the cylinder sleeve during rotation thereof. The closing plate 65 could be provided with an aperture for the tip 62 of the shaft 6 rather than a cavity 66. The closing plate 65 may be provided with a plurality of contact surfaces 63 rather than a continuous annular surface 63, in the same manner as the end plate 7 is suitably provided with a plurality of contact surfaces 23. The closing plate is suitably applied to the cylinder 10 either before or after the assembly of the shaft 6 to the cylinder 10. It could also be applied upon said assembly. Since the closing plate 65 is not intended for force transmission, it may be manufactured from a wide range of materials. Polymer materials and ceramic materials may be used in addition to metals.

Figure 6:
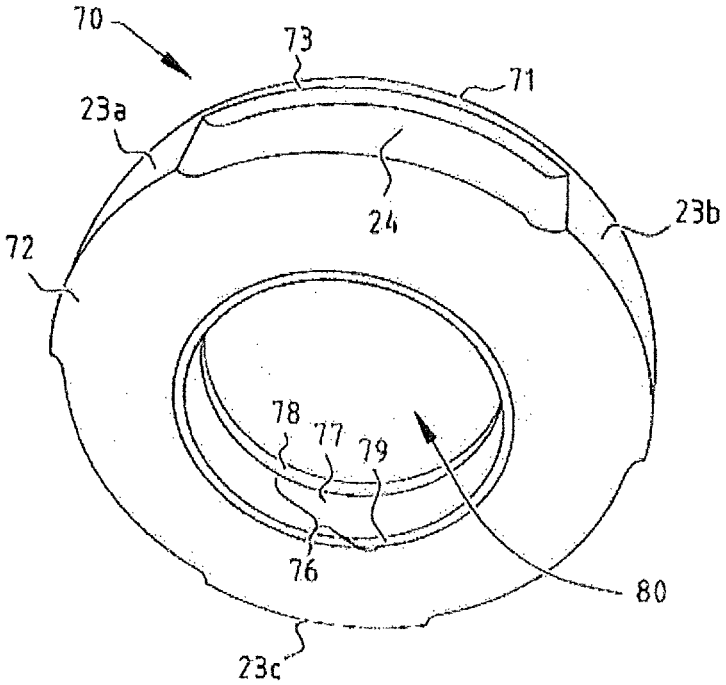
FIG. 6 shows a diagrammatical view of the further end plate for use in the system.

FIG. 6 shows in a bird's eye perspective a diagrammatical view of a further embodiment of an end plate. More particularly, this view merely shows an outer annular part 70 of the end plate. This outer part 70 comprises a first side 71 and a second side 72. The first side 71 is the side that faces the cylinder (not shown) when the end plate is moved towards the cylinder. The outer part 70 is provided with the contact surfaces 23*a*-23*c*, in between of which retracted surfaces 24 are present. In this embodiment, the contact surfaces 23*a*-23*c* are tapered, such that their diameter at the first side 71 is smaller than the diameter at the second side 72. The tapering has an oblique angle relative to the central axis which is at most 5 degrees. In one preferred embodiment, as shown in this FIG. 6, the oblique angle is even smaller than 3 degrees. The outer part 70 is further provided with a stopping edge 73. This is arranged on the circumference at the first side 71 and is configured so as to be continuous with the contact surfaces 23*a*-*c*. Such a stopping edge 73 is deemed beneficial for a correct arrangement of the end plate relative to the cylinder.

The outer annular part 70 further comprises an aperture 80 at its inside. This aperture 80 is configured for assembly of an inner annular part (not shown). The inner annular part will be composed of at least two elements to be assembled to the outer part 70 from the first side 71 and the second side 72. The surface 76 at the aperture 80 is thereto made convex. In this implementation, the surface 76 is thereto provided with a main, cylindrical section 77 and tapered sections 78, 79 on opposed sides 71, 72 thereof. A radial extension of the inner annular part will rest on such tapered section 78, 79 or even extend on the first or second side 71, 72 of the outer part 70. The two elements of the inner part need not to be equal in size and need not to be made of the same material. Rather one can be dominant (the body) and the other, the connection means, may be minor. Rather than two elements, a plurality of elements could be used.

Rather than using an inner annular part composed of at least two elements, use may be made of an inner annular part of a single element. This type is suitably provided with means for contact with the outer annular part. Examples of such means include a flange configured to reside on the first side 71, a protrusion or other mechanical locking means configured for locking to the surface 76. In such a situation, a convex surface 76 is not deemed necessary. Evidently, rather than using an additional annular part, the aperture 80 may be designed for the shaft 6.

Figure 7:
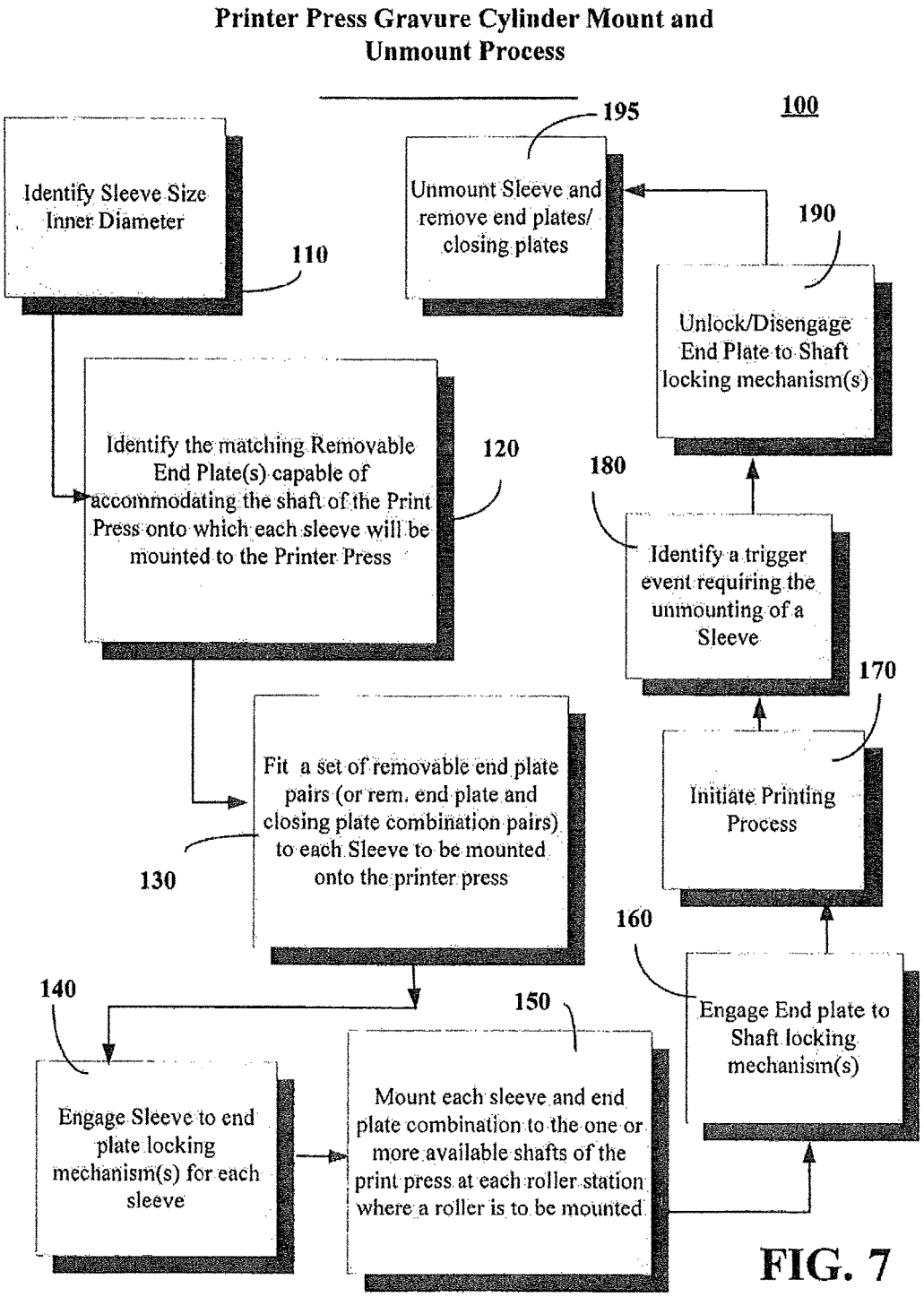
FIG. 7 is a flow diagram illustrating a gravure cylinder mount and unmount process.

FIG. 7 is a high level flow diagram of the printer press gravure cylinder mount and unmounts process 100 in accordance with an exemplary embodiment herein. This figure graphically illustrates the steps followed by a technician during the mounting and un-mounting of a sleeve configured using the presently described removable end plate approach.

Starting at step 110, a technician is provided with a certain size sleeve which he must inspect to identify the proper removable end plates that are to be selected. The critical geometric features to be identified or deduced include sleeve inner diameter size. The present invention contemplates providing automatic or visual aid selection features (such as color codes, markings, or other visuals) either directly on the sleeve or provided in some other fashion to the technician to aid in the identification process.

At step 120, the technician identifies and selects the matching removable end Plate(s) capable of accommodating the shaft of the print Press onto which a sleeve will be mounted. Where a print operation involves the mounting of parallel gravure cylinders/sleeves across a series of roller stations, a separate set of end plates are needed. Assuming the shafts at each station and the sleeves to be mounted thereto are all identical, then each end plate combination to be fitted to the sleeve and mounted to a shaft will likewise be identical.

At step 130, once the end plates are selected (or in the case of a single shaft print press configuration, a single end plate and a corresponding closing plate pair) the pair is fitted in a manner earlier described above, onto each sleeve. At step 140, any locking mechanism provided to secure a stable and snug coupling between end plates and sleeve is then engaged. At step 150, the sleeve and matching selected end plate pair combination is then mounted by the technician onto the printing press by fitting onto or into the available shaft or shafts of the printing press.

At step 160, once mounted onto the shafts of the printing press, the sleeve or sleeves are then locked in position using any appropriate locking mechanism, including the mechanisms described above. At step 170, the technician initiates printing operations and monitors activities as they progress. At step 180, it is presumed that a trigger event requiring the un-mounting of one or more sleeves has occur. This trigger event may be the result of, for example, the print job having come to completion, or the result of a fault condition requiring the removal/un-mounting of a sleeve, or the result of a visual or other indication, indicative of a cylinder wear condition requiring the replacement of the cylinder sleeve by a new cylinder (or if not new, by a suitable resurfaced cylinder bearing the same cylinder image as that being removed). At step 190, the technician disengages any locking mechanisms thus freeing up the sleeve and end plate combination for removal (un-mounting) from the press. At step 195, the actual sleeve and end plates are removed and replaced or simply removed and set aside.

The process heretofore described of maintaining a stock of end plates ready to fit onto a sleeve at the time of print operation, locking the combination in place in a non-permanent fashion, mounting and, in some instances, locking the combination onto a print press using the available shafts, and when done, removing and setting aside the removable end plates to be used again with a different sleeve, has never been implemented before in any fashion. As previously described and explained, applicants have discovered that aluminum base sleeves can be easily fashioned such that an optimum but selectively limited number of pre-formed aluminum stock cylinders may be made available to choose from in order to fully accommodate a given range of cylinder widths and engrave layer circumferences.

Let us assume, by way of example, that a minimum sleeve circumference size is 250 mm, and a maximum circumference size is 850 mm. Let us also assume, that the sleeve manufacturing technique to be employed across the whole range of sleeves to be manufactured is a single thermal spray layer as described in the non-prepublished PCT/EP2013/067895. In an ideal situation, for any desired circumference, the largest possible outer diameter aluminum pre-form base is ordered with the thinnest possible wall thickness and accounting for the thickness of the thermal layer. For example, if a certain print job required an outer engrave layer circumference of 650 cm, if the smallest possible thermal sprayed engrave layer is, let's say, 5 cm thick, the desired outer circumference of the aluminum base should be 645 cm. If a desired wall thickness of the aluminum base can be no smaller than 10 cm, then an ideally sized (ignoring length) pre-formed aluminum cylinder I might wish to use is a cylinder that has an inner diameter of 635 cm, an outer diameter of 645 cm, and when engraved, provides the desired 650 cm circumference engrave layer called for in my customer's specifications. Unfortunately, calling up one's aluminum stock supplier and asking it to send you over a custom roll of preformed stock is neither practical nor possible. Fortunately, thermal spraying has many advantages over traditional plating, one of which is the ability to build a thermal layer to much higher thicknesses than what might be considered optimal in every case. This proves very beneficial in being able to use the build up of thermal sprayed copper layering, as a way to provide for fixed step-size selection of raw aluminum base material to choose from to build up a circumference to a sufficient width without necessarily having to unreasonably tradeoff aluminum size scalability for too much building up of a thermal layer.

Applicant has in fact determined that it is possible to achieve a stepped selection of aluminum preformed core material to cover a range of possible circumference sizes ranging from 250 to 850 cm using a predetermined number of fixed-increasing size aluminum stock bore dimensions. By fixing the wall thickness to, for example, 15 cm, and allowing for 5 cm maximum thermal spray layer thickness, it is possible to stage cylinder core outer diameter in increments of 20 cms. Having a fixed pool of aluminum cores to work with, if standardized in some way, also serves to provide a useful tool by which to set the outer diameter of removable end plates to be made available for use with sleeves as presently proposed. Thus, the present approach indirectly drives gravure industry toward standardization aimed to benefiting all involved thus driving down costs of gravure printing and hopefully attracting business from other printing technologies. It is envisioned that the process of selecting and matching a sleeve to the best fit aluminum preform stock, taking into account the flexibility and desirability of using stepped selection formula, may be automated.

Figure 8:
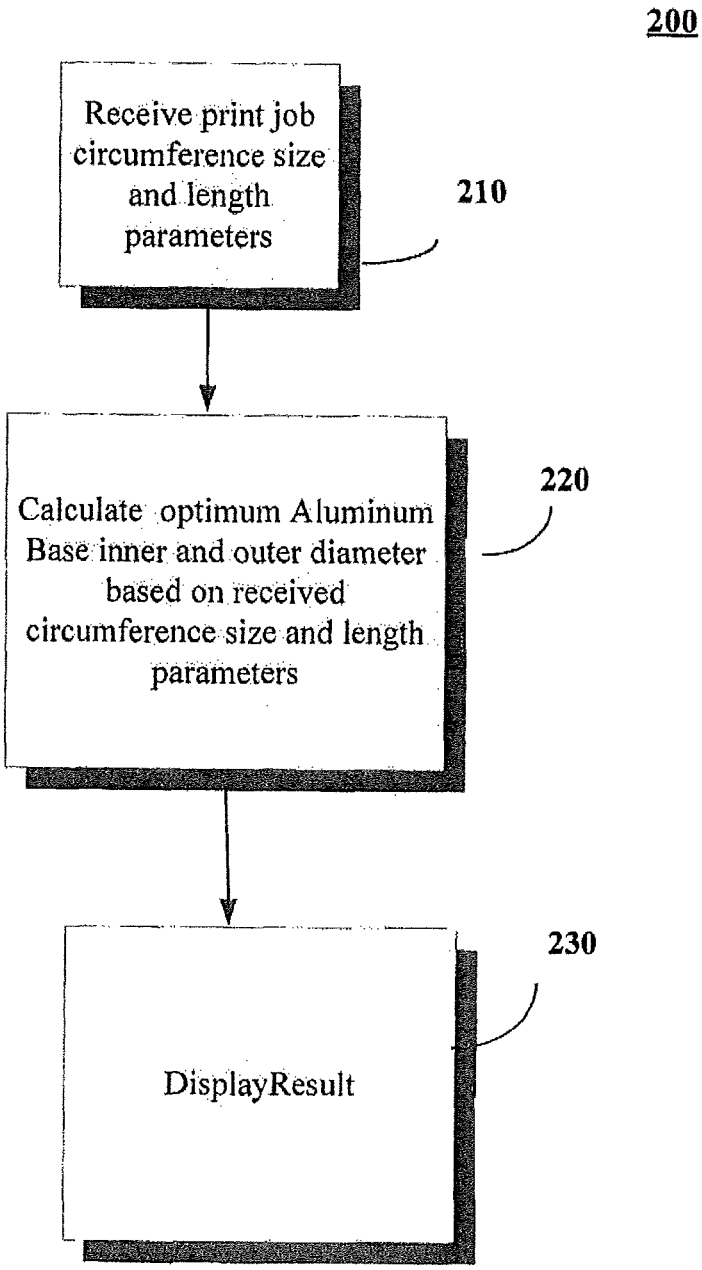
FIG. 8 is a flow diagram illustrating a sleeve size selection tool process.

FIG. 8 is a high level flow diagram of the sleeve size selection tool process 200 in accordance with a further exemplary embodiment.

At step 210, when a gravure cylinder sleeve manufacture order is received, a technician enters information into a platform, software package, online web-based tool or the like, which identifies the cylinder length and outer circumference specifications provided by the client.

At step 220, an algorithm crunches the numbers and identifies a best fit aluminum pre-form base. The algorithm may simply crunch numbers or perform a look up table function, to select an ideal sized stock, the optimum sized stock based on standardized available options programmed into the system, or it may seek and identify a best stock material from that currently available on hand.

In one scenario, functionality may be provided to assist in the ordering of a selected stock material. At step 230, the result is displayed and action is taken by the technician. In one scenario, cylinder length information is taken into account in selecting a different size or thickness stick material to account for instability and other forces that must be taken into account in a sleeve being provided which is flangeless.

Tests were carried out for comparison of ink consumption for printing of different cylinder sleeve. A prior art cylinder sleeve was tested, comprising a chrome protection coating. Furthermore, cylinder sleeves were tested based on the inventive process underlying the invention, comprising a layer package of thermally sprayed layers onto a base of aluminium. Use was made of the equipment as identified in PCT/EP2013/067895. The cylinders were provided with identical test patterns. The engraving layer of the layer package according to the invention was measured to have a Vickers Hardness of 532 HV, as based on five different measurements. The surface roughness Rz turned out to be 0.35 μm before printing for the engraving layer, which reduced to 0.26 μm after that a first printing run was carried out. The Ra was 0.04 μm before printing, which reduced to 0.025 μm after the first print run. Use was made of a conventional rotogravure printing system comprising a doctor blade system operating on the rotogravure cylinder, so as to remove any ink that is present on the surface rather than within the gravure (i.e. the grooves thereof). The ink saving turned out to be 10-15%.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The invention claimed is:

1. A method of operating a rotogravure printing system comprising a machine provided with at least one rotatable shaft and an end plate for transfer of shaft rotation to a cylinder sleeve, which system further comprises a first rotogravure cylinder sleeve having a first base and a first gravure at a printing surface comprising a first outside layer package deposited over the first base and a second rotogravure cylinder sleeve having a second base and a second gravure at a printing surface comprising a second outside layer package deposited over the second base, said first base and second base being of the same size while said first printing surface and said second printing surface are of different outside diameter sizes, each first and second base contains aluminum or aluminum alloy, each first and second outside layer package comprises at least one high-velocity thermally sprayed copper or copper alloy layer, and each layer of the first layer package and the second layer package has a hardness greater than the base, and said rotogravure cylinder sleeves are to be rotated by means of the at least one shaft and an end plate coupled thereto, which method comprises:

(a) assembling the end plate and the first rotogravure cylinder sleeve, which end plate is provided with at least one contact surface that is designed for contact with a mating contact surface defined at an inner side of each of the cylinder sleeves, (b) mounting the end plate and the first rotogravure cylinder sleeve onto the shaft;

(c) carrying out a first printing operation, comprising the step of rotating the at least one shaft, and therewith the first rotogravure cylinder, so as to print the substrate in accordance with the gravure of the first rotogravure cylinder sleeve, and thereafter, (d) disassembling the end plate and the first rotogravure cylinder sleeve, (e) assembling the end plate with the second rotogravure cylinder sleeve, and (f) carrying out a second printing operation with the gravure of the second rotogravure cylinder sleeve.

2. The method as claimed in claim 1, wherein the assembling of the end plate and the cylinder sleeve occurs after mounting of the cylinder sleeve and the end plate onto the shaft.

3. The method as claimed in claim 2, wherein the assembling comprises moving the at least one rotatable shaft and end plate, towards a lateral end of the rotogravure cylinder, and positioning the end plate into an inside of the cylinder, such that the mating contact surfaces of the cylinder and the end plate contact each other.

4. The method as claimed in claim 1, wherein the assembling of the end plate and the cylinder sleeve occurs prior to mounting of both onto the shaft.

5. The method as claimed in claim 1, further comprising the step of selecting an end plate from a series of end plates with varying diameters, so as to fit the mating contact surface of the first rotogravure cylinder sleeve for the first printing operation or of the second rotogravure cylinder sleeve for the second printing operation.

6. The method as claimed in claim 1, wherein the end plate is reused for a further cylinder sleeve in a subsequent printing operation.

7. A combination of rotogravure cylinder sleeves each provided with a gravure at a printing surface, and an end plate for transfer of rotation of a shaft to be inserted through the end plate to a first or to a second of the rotogravure cylinder sleeves, wherein the end plate is provided with at least one contact surface, and each of the rotogravure cylinder sleeves is provided with a mating sleeve contact surface defined at an inner side thereof, wherein each of the sleeve contact surfaces is sized and configured to assemble and disassemble from the end plate, wherein the first and second rotogravure cylinder sleeves each comprises a base and an overlaid layer package deposited at an outside of the base, the base is provided with a bore receiving the end plate and has a wall with a thickness that contains aluminum or aluminum alloy, wherein the overlaid layer package comprises at least one layer that is a high-velocity thermally sprayed copper or copper alloy layer, and each layer of the layer package has a hardness greater than the base.

8. The combination as claimed in claim 7, wherein the mating sleeve contact surfaces are tapered.

9. The combination as claimed in claim 7, wherein the contact surface of at least one of the cylinder sleeves is obtained by partial removal of the base.

10. The combination as claimed in claim 7, wherein the end plate has a first, second and third contact surface, that are mutually spaced when viewed along a circumference of the end plate.

11. The combination as claimed in claim 10, wherein the contact surfaces are mutually separated by retracted portions, so as to define cavities between the end plate and the cylinder sleeves.

12. The combination as claimed in claim 7, wherein the end plate and the cylinder sleeves are provided with mutually complementary mechanical locking means.

13. The combination as claimed in claim 7, wherein the end plate comprises an inner annular part and an outer annular part, which outer annular part is provided with said contact surfaces.

14. The combination as claimed in claim 7, wherein the layer package comprises an engraving layer with a Vickers Hardness in the range of 300-600 HV.

15. A rotogravure printing system comprising a machine provided with at least one rotatable shaft and a first rotogravure cylinder sleeve and a second rotogravure sleeve, each provided with a gravure at a printing surface, which cylinder sleeve is to be rotated by means of the at least one rotatable shaft, and further comprising an end plate for transfer of said rotation of the shaft to each of the first and second rotogravure cylinder sleeves, wherein the end plate is provided with at least one contact surface, and each of the first and second rotogravure cylinder sleeves is provided with a mating sleeve contact surface defined at an inner side thereof, wherein each of the sleeve contact surfaces is sized and configured to assemble and disassemble from the end plate, wherein the first and second rotogravure cylinder sleeves each comprises a base and an overlaid layer package deposited at an outside of the base, wherein the base is provided with a bore receiving the end plate, has a wall with a thickness that contains aluminum or aluminum alloy, wherein the overlaid layer package comprises at least one layer that is a high-velocity thermally sprayed copper or copper alloy layer, and each layer of the layer package has a hardness greater than the base.

16. The combination of claim 7, wherein the bore of the base has standardized stock bore dimensions to match the end plate and wherein the layer package has a thickness larger than needed for engraving and arranged to resize the layer package thickness of the rotogravure cylinder sleeve to a desired outer diameter of the rotogravure cylinder sleeve.

17. The combination of claim 16, wherein the layer package has a thickness in the range of 5 to 15 mm.

18. The combination of claim 16, wherein the base has a wall thickness in the range of 10-15 mm.

19. The combination of claim 16, wherein the layer package comprises high-velocity thermally sprayed copper layering.

* * * * *